US005479143A

United States Patent [19]

Payet-Burin

[11] Patent Number: 5,479,143

[45] Date of Patent: Dec. 26, 1995

[54] MULTIPOLE CIRCUIT BREAKER WITH MODULAR ASSEMBLY

[75] Inventor: Jean-Luc Payet-Burin, Voreppe, France

[73] Assignee: Merlin Gerin, France

[21] Appl. No.: 358,671

[22] Filed: Dec. 19, 1994

Related U.S. Application Data

[63] Continuation-in-part of Ser. No. 215,717, Mar. 22, 1994, abandoned.

[30] Foreign Application Priority Data

Apr. 7, 1993 [FR] France ..... 93 04296

[51] Int. Cl.[6] ..... H01H 9/02

[52] U.S. Cl. ..... 335/202; 335/16; 335/8

[58] Field of Search ..... 335/8–10, 16, 335/147, 195, 202; 200/144 R

[56] References Cited

U.S. PATENT DOCUMENTS 3,412,349 11/1968 Laubenheimer ..... 335/9
4,470,028 9/1984 Vayre et al. .
5,025,236 6/1991 Miura et al. .
5,231,365 7/1993 Kato ..... 335/132
5,258,729 11/1993 Link et al. ..... 335/202

FOREIGN PATENT DOCUMENTS 0079819 5/1983 European Pat. Off. .
2592212 6/1987 France .

*Primary Examiner*—Lincoln Donovan
*Attorney, Agent, or Firm*—Parkhurst, Wendel & Rossi

[57] ABSTRACT

Each breaking module is formed by a parallelepipedic monoblock cartridge made of plastic material, housed in the corresponding compartment of the base plate, said cartridge housing at least a stationary contact, an arc extinguishing chamber, and a pair of connecting strips for connection to a terminal and to the trip module of the same pole. A mechanical actuation module constituted by the switching bar and mechanism assembly, is securedly united to the cover. The rotary trip bar is supported by clipping means, arranged on the bottom face of the cover. A plurality cf recesses and cutouts are arranged in the spacers of the base plate to act as first bearing surfaces respectively for the switching bar and trip bar when the first sub-assembly A composed of the base plate with the set of breaking modules and trip modules, is adjoined with the second sub-assembly B formed by the cover on which the mechanical actuation module, trip bar and latch are fitted.

8 Claims, 5 Drawing Sheets

MULTIPOLE CIRCUIT BREAKER WITH MODULAR ASSEMBLY

This is a continuation-in-part of application Ser. No. 08/215,717 filed Mar. 22, 1994, now abandoned.

BACKGROUND OF THE INVENTION

The invention relates to a multipole circuit breaker with molded insulating case comprising:

- a base plate subdivided by spacers into several juxtaposed compartments for housing the different poles, each pole comprising a breaking module with separable contacts and a trip module,
- a cover fixed onto the base plate to close the case,
- an operating mechanism, mounted between a pair of support plates, and having a toggle device associated with a connecting spring, and with a tripping hook,
- a handle coupled to the mechanism, and passing through an aperture of the cover to be accessible from outside,
- a switching bar made of insulating material acting as support for the movable contacts of all the poles, the bar being mechanically coupled to the toggle device and being mounted with limited rotation between the closed position and the open position of the contacts,
- a trip bar cooperating with the trip modules of the poles, and with a latch of the tripping hook.

Depending on the type of the customer's electrical installation, protective circuit breakers may be single-pole or multipole with two, three or four poles. Depending on the circuit breaker rating and the type of protection required, certain components or parts, notably the mechanism, switching bar, contact parts, extinguishing chambers, and trip devices moreover have to be suitably adapted. To achieve this a range of circuit breakers requires a multitude of alternative versions. Manufacturing such a range gives rise to assembly problems, as the parts or components to be adapted do not always have the same shapes or structures, and are not easily interchangeable.

SUMMARY OF THE INVENTION

The object of the invention is to achieve a multipole circuit breaker having a modular architecture enabling several types to be built up with modules of standard dimensions.

The circuit breaker according to the invention is characterized in that:

- each breaking module is formed by a parallelepipedic monoblock cartridge made of plastic material, housed in the corresponding compartment of the base plate, said cartridge housing at least a stationary contact, an arc extinguishing chamber, and a pair of connecting strips for connection to a terminal and to the trip module of the same pole,
- a mechanical actuation module, constituted by the switching bar and mechanism assembly, is securedly united to the cover,
- the rotary trip bar is supported by clipping means, arranged on the bottom face of the cover,
- and a plurality of recesses and cutouts arranged in the spacers of the base plate to act as first bearing surfaces respectively for the switching bar and trip bar when the first sub-assembly A composed of the base plate with the set of breaking modules and trip modules, is adjoined with the second sub-assembly B formed by the cover on which the mechanical actuation module, trip bar and latch are fitted.

A whole range of molded insulating case circuit breakers can be manufactured from the different types of breaking, trip and mechanical actuation modules according to the required performances and ratings. The structure of the case, for a predetermined number of poles, remains identical regardless of the modules chosen for assembly. Positioning of the switching bar is performed at the same time as that of the trip bar when the two pre-assembled sub-assemblies are adjoined.

On the base plate side, the bar is positioned in two lower half-bearings formed by juxtaposition of the recesses of the spacers, and of the notches provided in the large side panels of the cartridges. On the cover side, the upper half-bearings of the bar are formed by curved bearing surfaces securedly united to the mechanism support plates.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DETAILED DESCRIPTION OF THE PREFERRED EMBODIMENT

Figure 1:
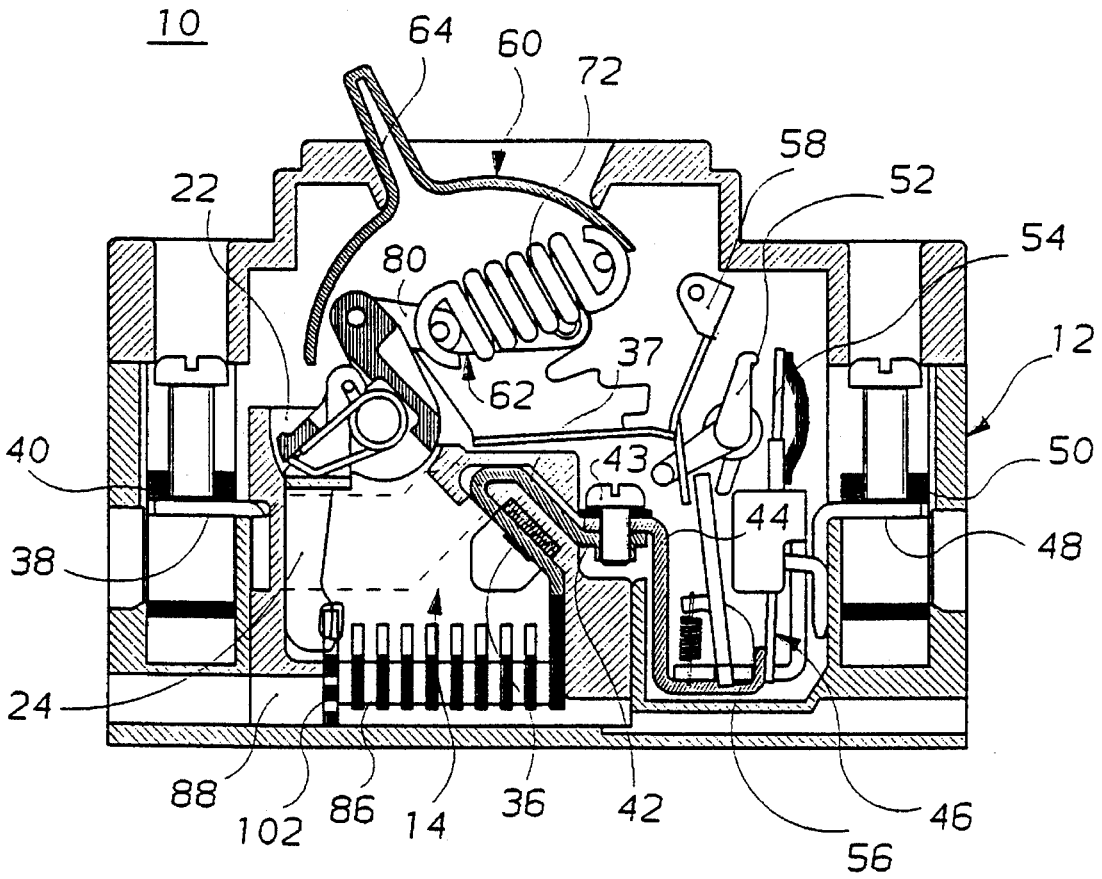
FIG. 1 is a schematic sectional view of a multipole circuit breaker according to the invention, represented in the open state of the contacts.
Figure 2:
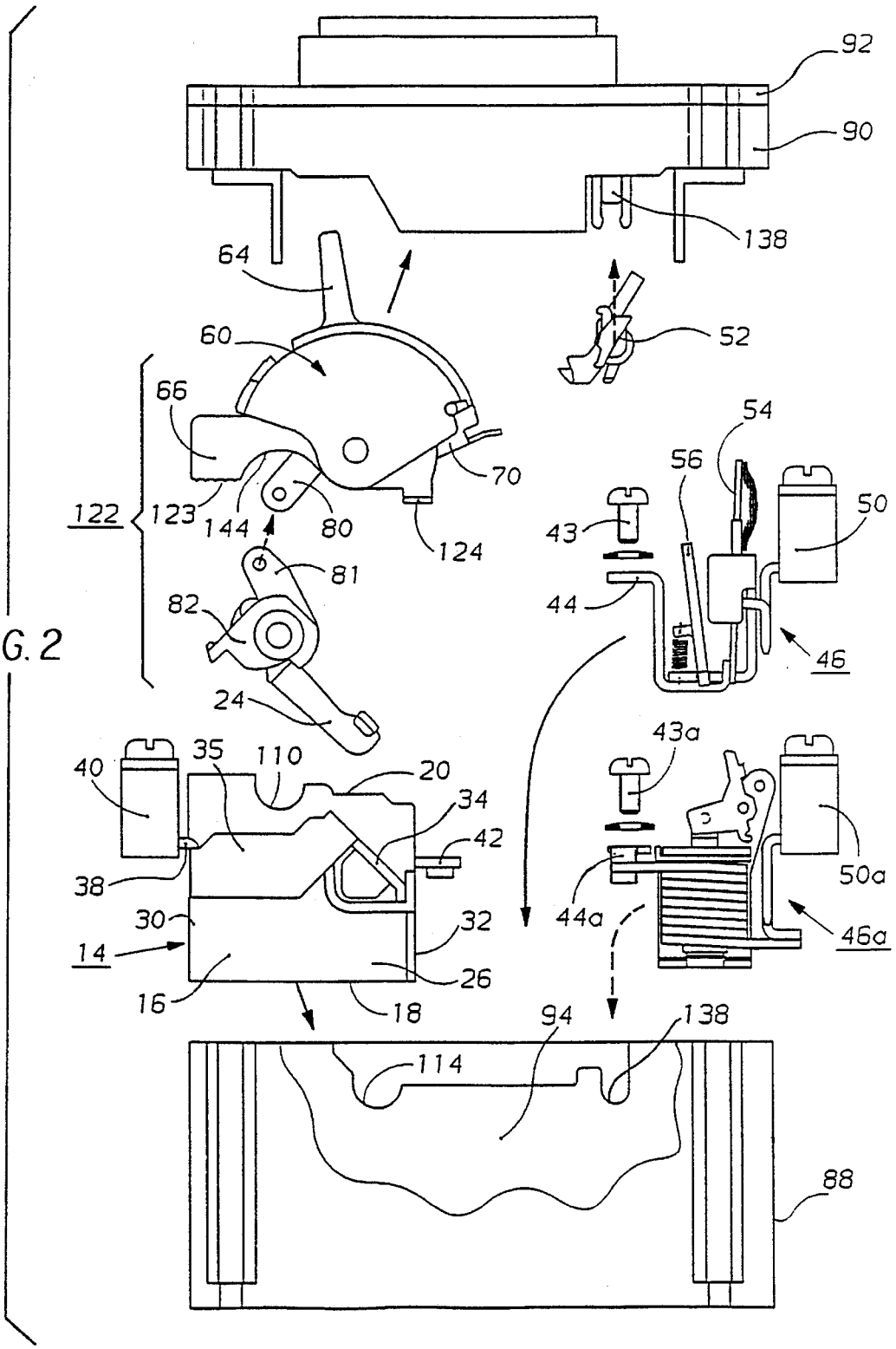
FIG. 2 shows an exploded view of the different modules constituting the circuit breaker of FIG. 1.

In FIGS. 1 and 2, a pole of a multipole circuit breaker 10 with molded insulating case 12 comprises a single-pole breaking module 14, formed by a monoblock cartridge 16 made of molded plastic material, and having the shape of a parallelepiped rectangle. The cartridge 16 comprises a base plate 18, a front panel 20 having an orifice 22 for passage of the movable contact 24, two parallel large side panels 26, 28 and two parallel small side panels 30, 32 for connection.

Inside the cartridge 16 there are located two stationary contacts 34, 36 respectively connected by connecting conductors 35, 37 to a first contact strip 38 of a connection terminal 40, and to a second contact strip 42 designed to be connected by a screw 43 to a third contact strip 44 of a trip module 46.

The trip device comprises a trip module 46, the one in FIG. 1 being formed by a magnetothermal trip device, equipped opposite from the contact strip 44 with a fourth contact strip 48 forming part of the other connection terminal 50 of the pole. The trip module 46 is connected in series in the pole with the contacts 34, 36, 24 of the breaking module 14.

In the closed state of the circuit breaker, the current enters via the input terminal 40, and flows successively in the conductor 35, stationary contact 34, movable contact 24, other stationary contact 36, conductor 37, contact strips 42, 44, trip device 46, and output terminal 50.

The trip device comprises in addition a trip bar 52 mounted with limited rotation between a charged position and a tripped position according to the position of the component actuating the trip device 46, for example the bimetal strip 54 or blade 56. The rotary bar 52 is moved to the tripped position as soon as the current flowing in the pole exceeds a preset threshold. The trip bar 52 moreover cooperates with a latch 58 of an operating mechanism 60 with toggle 62 and handle 64.

The mechanism 60 is common to all the poles, and is housed in the case 12 between two metal support plates 66, 68, only the handle 64 being accessible from outside passing through an aperture 65 of the case 12, for operation of the circuit breaker 10.

The mechanism 60 comprises a tripping hook 70 pivotally mounted on the parallel support plates 66, 68, the free end of the hook 70 being engaged with the latch 58 in the charged position. A connecting spring 72 is secured between the articulation spindle 74 of the toggle 62 and a spindle 76 securedly united to the base 78 of the handle 64.

The lower rod 80 of the toggle 62 is coupled to a protuberance 81 of a switching bar 82 acting as support for the movable contacts 24 of all the poles. The switching bar 82 is made of insulating material and extends parallel to the trip bar 52 in the transverse direction of the poles. The upper rod of the toggle 62 is articulated on the tripping hook 70.

An unlocking action of the trip bar 52 on the latch 58 releases the hook 70, which is unlatched due to the expansion action of the connecting spring 72, resulting in movement by pivoting of the toggle 62, and rotation of the bar 82 to the open position of the contacts 34, 36, 24 of all the poles. The order to unlock the latch 58 can come from the magnetothermal trip module 46, or from an auxiliary trip device, notably a shunt release MN, closing release iX, differential trip device, etc.

The breaking module 14 in addition houses two arc extinguishing chambers, one 84 of which is represented in FIG. 1. The outlet from the chamber 84 is in communication with an opening 86 for the breaking gases to escape to the outside of the cartridge 16.

Figure 7:
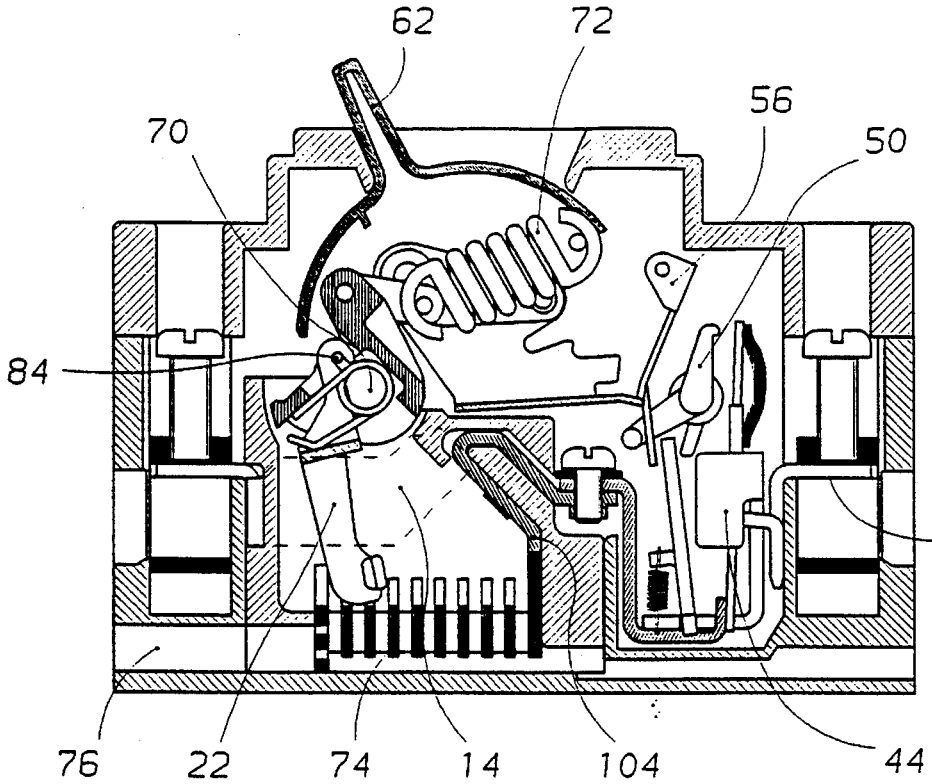
FIG. 7 is a plane view of the sub-assembly A of FIG. 6.

According to FIG. 2, the insulating case 12 of the circuit breaker 10 is composed of a base plate 88 on which an assembly comprising a cover 90 and closing front plate 92 is fitted from the top. The inside of the base plate 88 is subdivided by intermediate spacers 94, 95 into several juxtaposed compartments 96, 98, 100 for housing the different poles. In FIG. 7, the two side compartments 96 and 100 are represented as being empty, whereas the middle compartment 98 is illustrated with a cartridge 16 of a breaking module 14 installed in the left-hand part, and a trip module 46 in the right-hand part.

In FIG. 2, the magnetothermal tripping module 46 can be replaced by another trip module 46a, for example of the electromagnetic type with a wide tripping threshold setting range, such as is described in French Patent FR 2,639,148.

Figure 4:
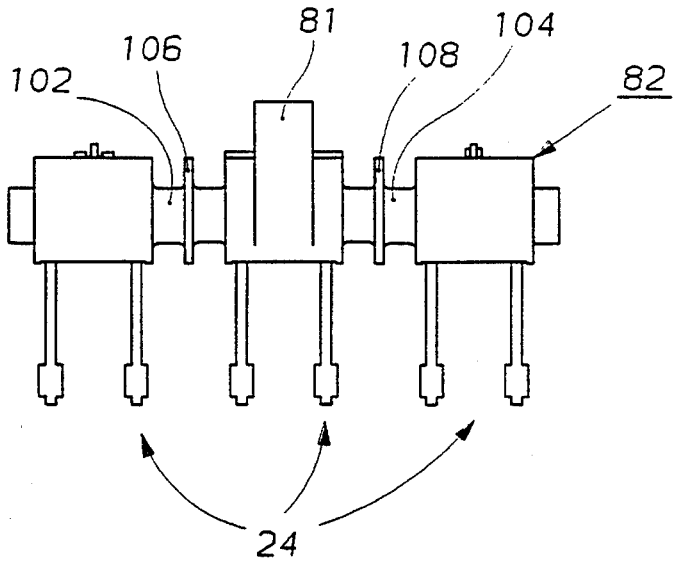
FIG. 4 represents an elevational view of the switching bar, equipped with the movable contacts.

The switching bar 82, shown in detail in FIG. 4, is equipped with three fork-shaped movable contact assemblies 24, located at regular intervals along the transverse direction of the bar 82. The two intermediate sections of the bar 82 both have a cylindrical bearing surface 102, 104 provided in the middle zone with a centering ring 106, 108.

In FIG. 7, the large side panels 26, 28 of each cartridge 16 comprise a pair of-U-shaped notches 110, 112, facing the front panel 20. The same is true of the upper edges of the spacers 94 and 95 of the base plate 88, which are provided with a pair of concave recesses 114, 116, aligned with the respective notches 110, 112 of the cartridges 16 in the transverse direction.

The spacers 94, 95 moreover present elongated apertures 118, 120 extending in the longitudinal direction so as to arrange small separating gaps between the compartments 96, 98, 100.

Figure 3:
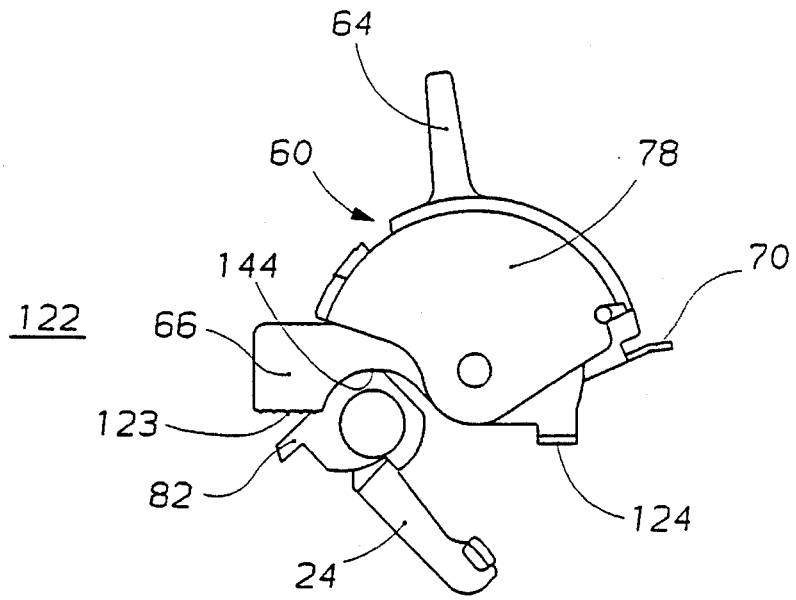
FIG. 3 shows the mechanical actuation module formed by assembly of the switching bar to the operating mechanism.

From FIG. 2, coupling of the protuberance 81 of the bar 82 to the lower rod 80 of the mechanism 60 enables the mechanical actuation module 122 of FIG. 3 to be obtained. The two parallel metal support plates 66, 68 of the mechanism 60 are provided with positioning lugs 123, 124 bearing on the spacers 94, 95 when the cover 90 is fitted onto the base plate 88.

Figure 5:
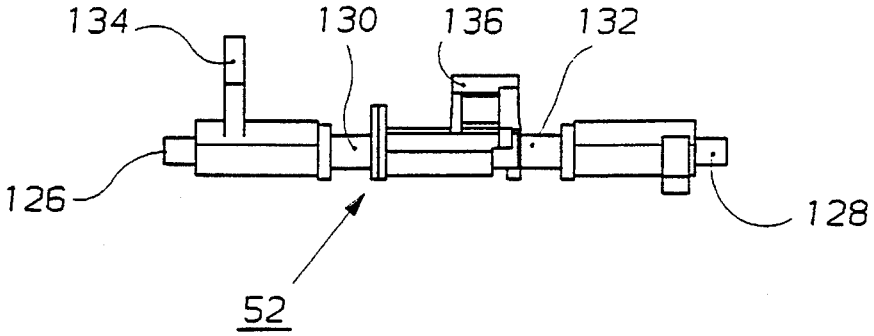
FIG. 5 is an elevational view of the trip bar.

In FIG. 5, the trip bar 52 made of molded insulating material, comprises two cylindrical ends 126, 128, two cylindrical intermediate bearing surfaces 130, 132, an actuating pin 134 designed to be operated by a tripping auxiliary, and an operating spigot 136 of the latch 58.

The bottom face of the cover 90 (FIGS. 2 and 8) comprises on the opposite edges two flexible support tabs 138, 140 able to receive the two ends 126, 128 by clipping to perform prepositioning of the trip bar 52 on the cover 90. The latch 58 is also securedly united to the bottom face of the cover 90, preferably in the middle zone to cooperate with the operating spigot 136 associated with the trip bar 52.

In addition to the recesses 114, 116 in the left-hand part of the spacers 94, 95 for housing the bar 82, other U-shaped cutouts 138, 140 are provided in the right-hand part of the spacers 94, 95 (FIG. 7) to receive the cylindrical bearing surfaces 130, 132 Of the trip bar 52.

From the different standard modules 14, 46, **46*a*, 122, a whole range of molded case circuit breakers can be manufactured depending on the required performances and ratings. The latch 58 and trip bar 52 are two mechanical components securedly united to the cover 90, and remain the same regardless of the type of modules 14, 46, 46*a*, 122 used to constitute the circuit breaker 10**.

In addition to the two types of trip modules 46, **46*a*, different breaking modules 14** exist, either single-break or double-break, or with one or two arc extinguishing chambers equipped with a certain number of separators adapted to suit the breaking capacity of the circuit breaker.

The separation between the connection terminal strips 38, 42 is constant for all types of modules 14.

The mechanical actuation modules 122 are also adaptable to the power of the circuit breaker 10, since there exist switching bars 82 of different diameters, and mechanisms 60 with connecting springs 72 of specific hardnesses.

Manufacture of the circuit breaker 10 can be performed by an automatic assembling machine, after the standard modules 14, 46, **46*a*, 122 which are to be incorporated in the base plate 88 and cover 90** have been selected.

Figure 6A:
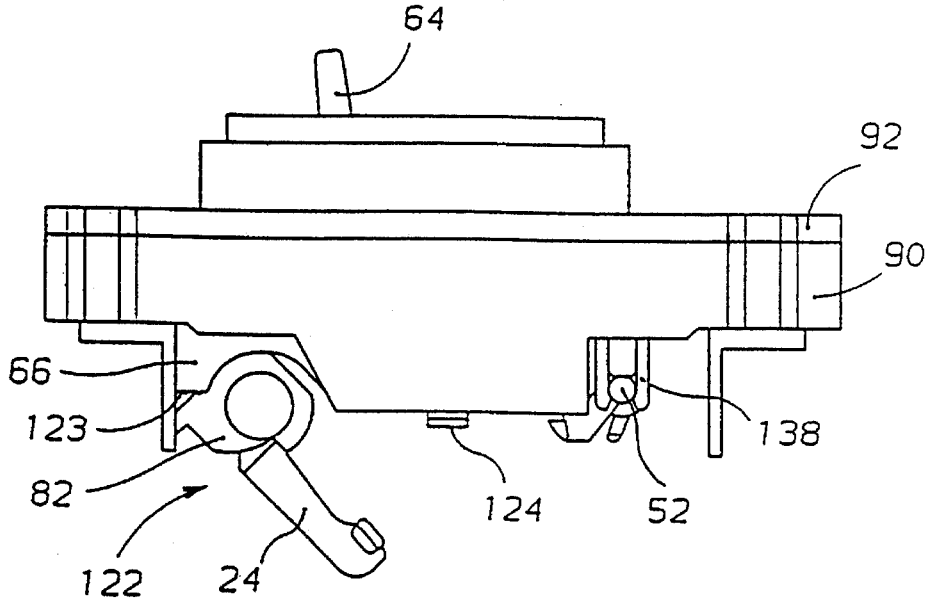
FIG. 6 shows the two pre-assembled sub-assemblies of the circuit breaker of FIG. 2.
Figure 6B:
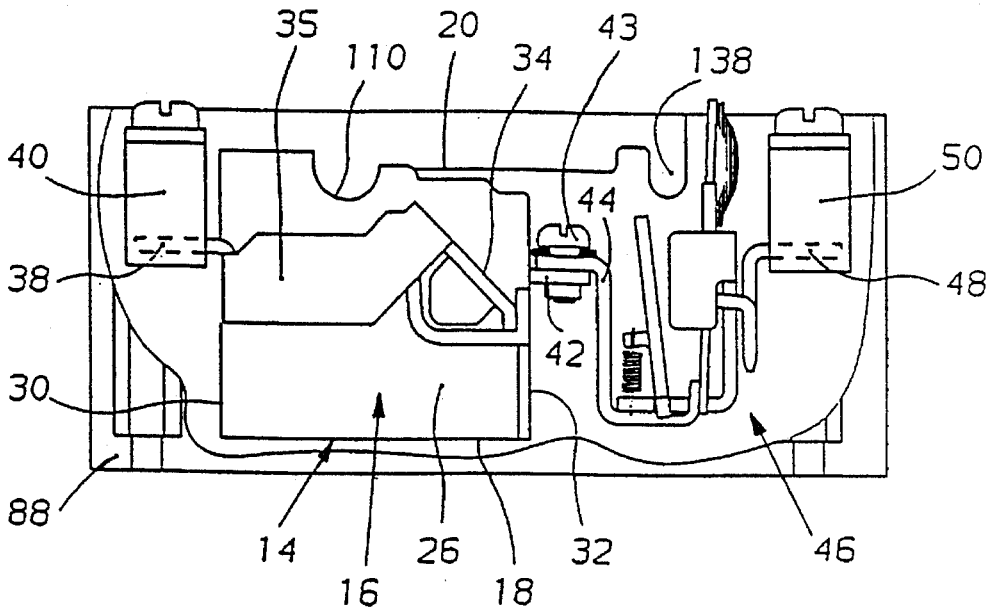
Figure 8:
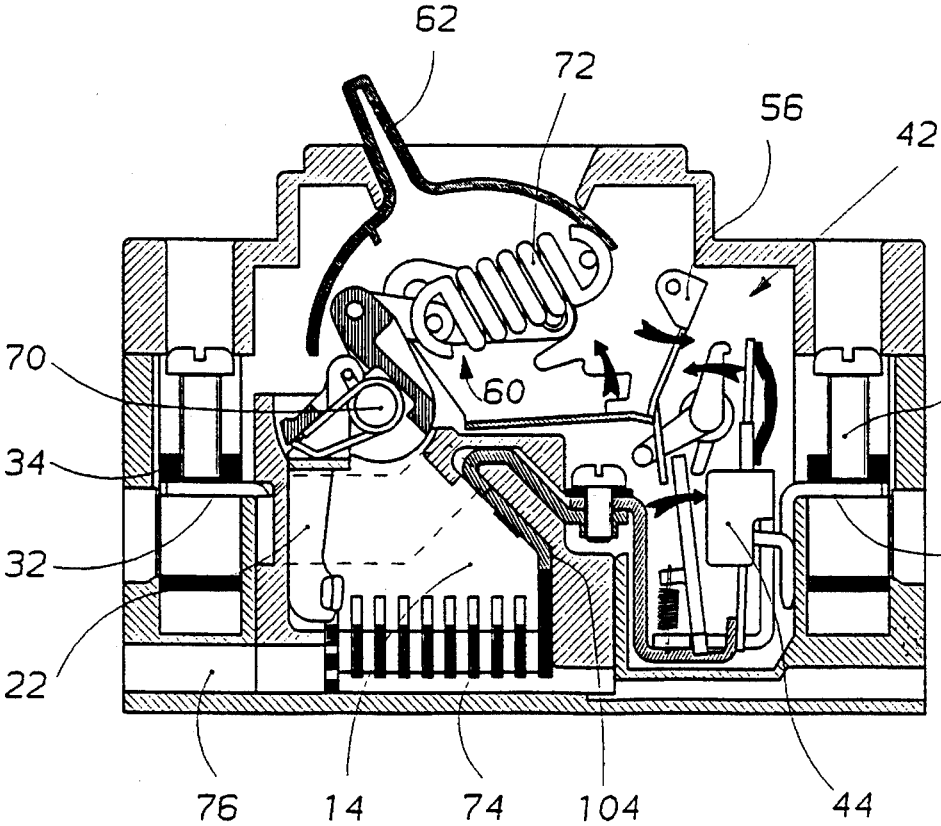
FIG. 8 is a bottom view of the sub-assembly B of FIG. 6.

In FIGS. 6 to 8, the circuit breaker 10 is formed by association of a first sub-assembly A comprising the base plate 88 housing the breaking module 14 and trip module 46 of the different poles, and a second sub-assembly B formed by the cover 90 and front plate 92, on which the mechanical actuation module 122, trip bar 52, and latch 58 are fitted.

Adjoining the two sub-assemblies A and B then enables the case 12 to be closed with the switching bar 82 and trip bar 52 being automatically placed in the respective bearings of the spacers 94, 95 of base plate 88. In the course of fitting of the second sub-assembly B onto the base plate 88, the movable contacts 24 of the switching bar 82 penetrate into the arc extinguishing chambers 84 via the respective orifices 22 of the cartridges 16.

The assembly is held in place by fixing screws (not represented) which secure the two sub-assemblies A and B against one another.

Fitting of the switching bar 82 with rotation is performed at the level of the junction plane of the two sub-assemblies A and B. The bearing surfaces 102, 104 are positioned between two lower half-bearings formed by the recesses 114, 116 of the spacers 94, 95 and the aligned notches 110, 112 of the cartridges 16, and two upper half-bearings formed by curved second bearing surfaces 144, 146, arranged in the bottom edges of the support plates 66, 68 of the mechanism 60.

I claim:

1. A multipole circuit breaker, comprising:

a molded insulating case having a base plate subdivided by spacers to form a plurality of juxtaposed compartments each having a pole, and a cover having an aperture secured onto the base plate to the close the insulating case, each pole comprising a breaking module and a trip module housed in a respective compartment, said breaking module and said trip module being secured to the base plate, each breaking module including a parallelepipedic plastic monoblock cartridge which houses at least one stationary contact, an arc extinguishing chamber and a pair of connecting strips for electrical connection to a terminal and to a respective trip module;

a mechanical actuation module secured to said cover and including an operating mechanism and a switching bar, said operating mechanism being mounted between a pair of support plates and including a toggle device having a tripping hook and a connecting spring, the toggle device being rotatable from closed to open positions via tripping of the tripping hook and a biasing force from the connecting spring, said switching bar being comprised of insulating material and supporting a plurality of movable contacts, each being cooperable with a respective stationary contact of a breaking module, said switching bar being mechanically coupled to the toggle device;

a latch adapted to engage the tripping hook;

a handle coupled to said operating mechanism and passing through the aperture in the cover;

a rotary trip bar clipped via clipping means to said cover and being rotatable to engage said latch to trip the poles of the circuit breaker via action of the trip modules, wherein a plurality of recesses are provided in the spacers of the base plate to form first bearing surfaces for the switching bar and the rotary trip bar.

2. The circuit breaker of claim 1, wherein each cartridge comprises a front panel having an orifice through which a respective movable contact extends, and two parallel large side panels which are connected to each other by said front panel, said first bearing surfaces further including notches formed in the large side panels, said notches being aligned with the recesses of the spacers.

3. The circuit breaker of claim 2, wherein the rotary trip bar includes at least two cylindrical bearing sections, each extending between two adjacent first bearing surfaces.

4. The circuit breaker of claim 3, wherein the support plates of the operating mechanism have a curved outer peripheral portion to form second bearing surfaces on which said rotary trip bar rotates.

5. The circuit breaker of claim 2, wherein at least one of the spacers includes an elongated open channel extending along a longitudinal direction of the at least one of the spacers, said rotary trip bar further including at least one centering ring which engages the channel.

6. The circuit breaker of claim 1, wherein the two support plates of the operating mechanism include positioning lugs which rest on the spacers of the base plate.

7. The circuit breaker of claim 1, wherein said clipping means comprises at least two pairs of flexible gripping tabs extending from said cover, the pairs of gripping tabs being spaced apart to receive opposite ends of the rotary trip bar, the rotary trip bar including at least two cylindrical bearing portions which rotate on the recesses of the spacers.

8. The circuit breaker of claim 2, wherein each cartridge further comprises two opposite parallel small side panels which connect the large side panels to each other, the connecting strips extending perpendicularly to the small side panels.

* * * * *